US006765539B1

(12) United States Patent
Wang et al.

(10) Patent No.: US 6,765,539 B1
(45) Date of Patent: Jul. 20, 2004

(54) PLANAR MULTIPLE BAND OMNI RADIATION PATTERN ANTENNA

(75) Inventors: Sen-Lu Wang, Hsinchu (TW); Tse-Lun Lee, Hsinchu (TW)

(73) Assignee: Input Output Precise Corporation, Hsin Tien (TW)

( * ) Notice: Subject to any disclaimer, the term of this patent is extended or adjusted under 35 U.S.C. 154(b) by 0 days.

(21) Appl. No.: 10/350,027

(22) Filed: Jan. 24, 2003

(51) Int. Cl.[7] ..... H01Q 9/28; H01Q 1/26
(52) U.S. Cl. ..... 343/795; 343/700 MS
(58) Field of Search ..... 343/795, 804, 343/891, 700 MS

(56) References Cited

U.S. PATENT DOCUMENTS 6,337,666 B1 * 1/2002 Bishop ..... 343/795
6,337,667 B1 * 1/2002 Ayala et al. ..... 343/795
6,339,405 B1 * 1/2002 Gleener ..... 343/795
2002/0190912 A1 * 12/2002 Lebaric et al. ..... 343/795

* cited by examiner

*Primary Examiner*—James Clinger
*Assistant Examiner*—Minh Dieu A
(74) *Attorney, Agent, or Firm*—Bacon & Thomas PLLC

(57) ABSTRACT

The present invention is to provide to a planar multiple band omni radiation pattern antenna having first and second patch lines printed on a planar dielectric substrate material, wherein a plurality of radiation members are formed bifurcately, symmetrically along both sides of a longitudinal axis of either patch line. Each of the radiation members comprises at least two post-shaped conductors each having a length slightly less than one-quarter wavelength of a central frequency of each operating frequency so as to form a choke and the radiation members of multi-frequency, and enable the operating frequencies not to be harmonically related.

11 Claims, 11 Drawing Sheets

PLANAR MULTIPLE BAND OMNI RADIATION PATTERN ANTENNA

FIELD OF THE INVENTION

The present invention relates to antennas and more particularly to a planar multiple band omni radiation pattern antenna having significant gains in the operating frequencies.

BACKGROUND OF THE INVENTION

A conventional antenna such as coaxial sleeve antenna mounted in a wireless communication device is illustrated in FIG. 1. As shown, the antenna comprises a coaxial transmission line 10 including an inner conductor (or core) 14, an outer conductor (or shielded mesh or ground line) 16, and a cylindrical film 17 of insulated dielectric material sandwiched between the inner and outer conductors 14 and 16 so that a concentric conductor as known in the electromagnetism is formed by both the inner and outer conductors 14 and 16. Also, an insulated cylindrical shell 19 is formed around the coaxial transmission line 10. The shell 19 has one end coupled to a control circuit (not shown) of a wireless communication device. A metal sleeve 18 is formed around the other end of the shell 19. The sleeve 18 and the outer conductor 16 are coaxial. The sleeve 18 has the top end coupled to the outer conductor 16 and the other portion not in contact with the outer conductor 16 by means of the shell 19 therebetween. An extension 12 is projected from the inner conductor 14 at the other top end of the coaxial transmission line 10. The extension 12 is above the sleeve 18 by a distance (i.e., length of the extension 12) about the length of the sleeve 18. But the length of each of the extension 12 and the sleeve 18 is slightly less than one-quarter wavelength at an optimum operating frequency (i.e., ¼ where 1 is wavelength of the operating frequency). As such, another concentric conductor is formed between the sleeve 18 and the outer conductor 16 for preventing the antenna from being interfered by a leakage current at the cylindrical surface of the outer conductor 16. Hence, a balum (i.e., balance-to-unbalance) converter is formed. As an end, a desired antenna radiation is generated by the coaxial sleeve antenna.

Typically, an omni radiation pattern antenna is mounted in a mobile or portable wireless communication device such as the widely used cellular phone. As a result, the wireless communication device can achieve a communication of 360 azimuthal degrees. The above sleeve antenna is the antenna being most widely mounted in the wireless communication device. Also, the sleeve antenna is widely mounted in a wireless communication device capable of receiving or transmitting signals at frequencies such as high frequency (HF), very high frequency (VHF), and ultra high frequency (UHF). The basic structure of the sleeve antenna is a metal sleeve. A balum converter is formed on the coaxial sleeve antenna. Moreover, a collinear structure is implemented in the coaxial sleeve antenna for increasing antenna gain and omni radiation pattern.

There has been a significant growth in wireless local Area network (WLAN) due to an increasing demand of mobile communication products in recent years in which IEEE 802.11 WLAN protocol is the most important one among a variety of WLAN standards. The IEEE 802.11 WLAN protocol was established in 1997. The IEEE 802.11 WLAN protocol not only provides many novel functions for WLAN based communication but also proposes a solution for communicating between mobile communication products made by different manufacturers. There is no doubt that the use of the IEEE 802.11 WLAN protocol is a milestone in the development of WLAN. The IEEE 802.11 WLAN protocol was further modified for being adapted to serve as a standard of both IEEE/ANSI and ISO/IEC in August 2000. The modifications comprise IEEE 802.11a WLAN protocol and IEEE 802.11b WLAN protocol. In an expanded standard physical layer, the operating frequencies have to be set at 5 GHz and 2.4 GHz. As such, the well-known coaxial sleeve antenna cannot satisfy the requirement of enabling a mobile communication product to use both IEEE 802.11a and IEEE 802.11b WLAN protocols at the same time. Instead, several antennas have to be mounted in the product for complying with the requirement of frequency band. However, such can increase a manufacturing cost, complicate an installation procedure, and consume precious space for mounting the antennas. As a result, the size of the product cannot be reduced, thereby contradicting the compactness trend.

Recently, there is a trend among wireless communication product designers and manufacturers to develop an antenna capable of operating in two different frequency bands (i.e., dual frequency) in developing communication products of dual frequency or multi-frequency. It is envisaged that the use of multi-frequency antenna in a wireless communication product can decrease the number of antennas provided therein and occupied space thereon. Unfortunately, commercially available multi-frequency antennas such as chip antennas or patch antennas made by a printing process are poor in performance at an operating frequency of 5 GHz. Some antennas such as one disclosed in U.S. Pat. No. 4,509,056 can meet required features. However, it is bulky or complicated in structure, resulting in an increase of manufacturing and assembly costs and unnecessary consumption of installation space. Further, a desired omni radiation is not easy to achieve if a radiation pattern has only one element. In addition, a high variation is occurred in manufacturing antennas operable in microwave due to very short wavelength of the microwave, resulting in a low yield. Hence, a need for improvement exists.

SUMMARY OF THE INVENTION

A primary object of the present invention is to provide a planar multiple band omni radiation pattern antenna. By utilizing this, the above drawbacks of the prior art such as bulky, complicated structure, uneasy to achieve the omni radiation, and low yield can be overcome.

One object of the present invention is to print first and second patch lines on a planar dielectric substrate material. A plurality of radiation members are formed bifurcately, symmetrically along both sides of a longitudinal axis of either patch line. Each of the radiation members comprises at least two post-shaped conductors each having a length slightly less than one-quarter wavelength of a central frequency of each operating frequency so as to form a choke and the radiation members of multi-frequency. Most importantly, the operating frequencies need not be harmonically related.

Another object of the present invention is to provide a planar printed antenna capable of operating at a plurality of frequencies of microwave. A radiation pattern of the antenna can cover 360 azimuthal degrees. Moreover, the radiation pattern of the antenna is printed on the dielectric substrate material. Thus, the present invention can decrease variations in the manufacturing process, increase yield and efficiency, and lower the manufacturing cost.

Still another object of the present invention is to provide an antenna having a collinear structure so as to compensate an antenna gain. As a result, the antenna not only can have an omni radiation pattern (i.e., azimuth) similar to that of the prior art sleeve antenna but also can have an antenna gain higher than that of the prior art sleeve antenna. Thus, the antenna is particularly suitable to microwave applications.

A further object of the present invention is to adjust a parasitic effect among the post-shaped conductors by suitably changing their shapes in order to obtain a resonance of multi-frequency.

The above and other objects, features and advantages of the present invention will become apparent from the following detailed description taken with the accompanying drawings.

DETAILED DESCRIPTION OF THE PREFERRED EMBODIMENTS

Figure 1:
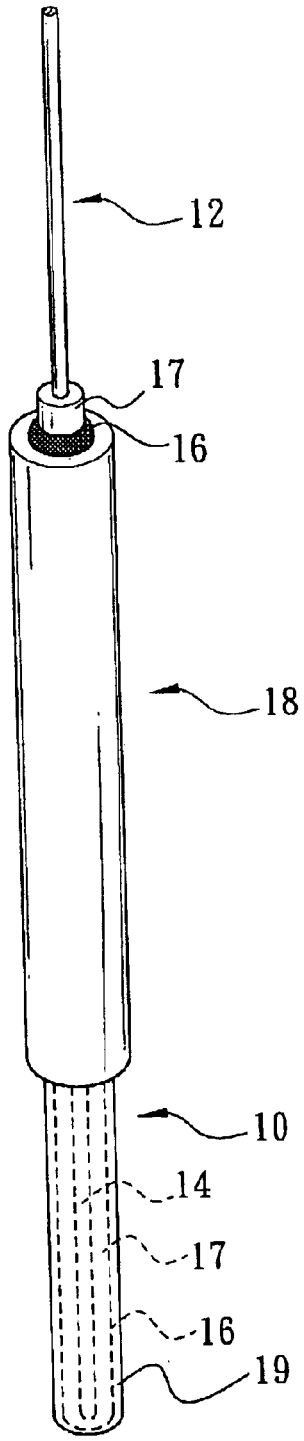
FIG. 1 (Prior Art)
FIG. 1 is a perspective view in part section of a conventional coaxial sleeve antenna.
Figure 2A:
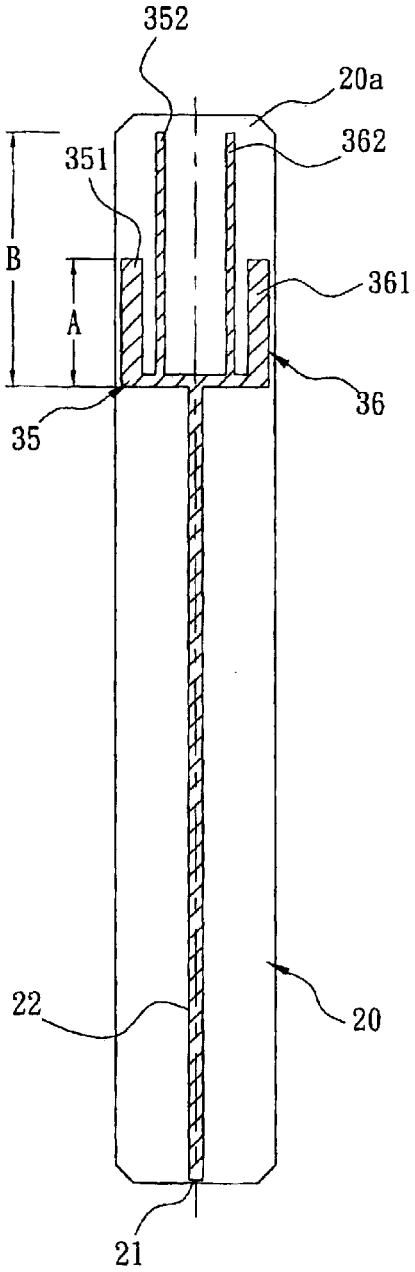
FIGS. 2*a* and 2*b* are cross-sectional views taken from the front and the rear respectively of a planar multiple band omni radiation pattern antenna according to a first preferred embodiment of the invention.
Figure 2B:
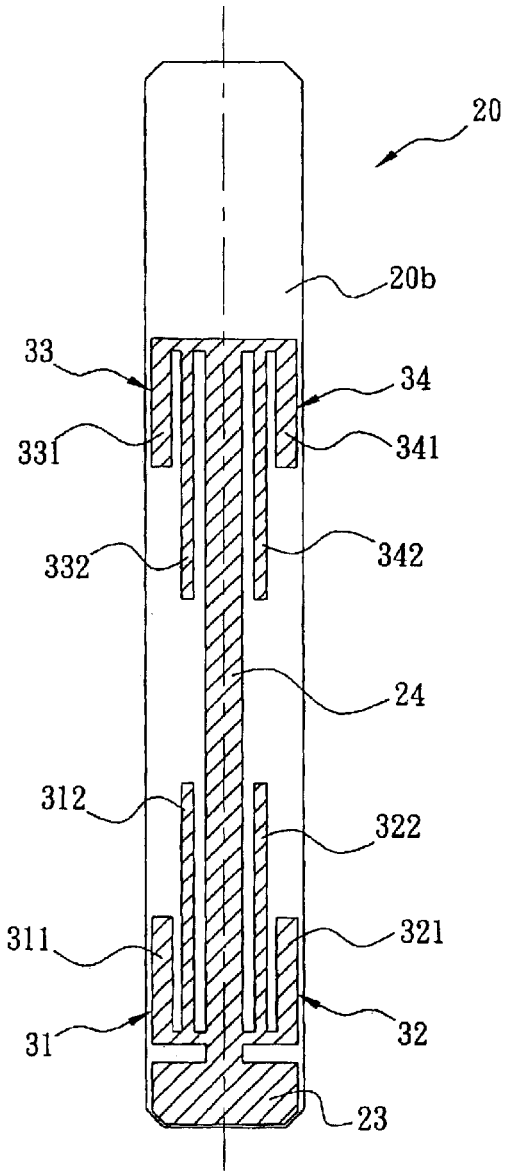

Referring to FIGS. 2*a* and 2*b,* there is shown an antenna in accordance with a first preferred embodiment of the invention. The antenna comprises a planar dielectric substrate material 20, a first patch line 22, and a second patch line 24. Both of the first and second patch lines 22, 24 are printed on a front side 20*a* and a rear side 20*b* of the dielectric substrate material 20 respectively. The first patch line 22 printed on the front side 20*a* is a signal transmission line. One end of the first patch line 22 is formed as a signal feed point 21 which is coupled to a control circuit (not shown) of a wireless communication device via a coaxial cable. The other end of the first patch line 22 is bifurcated lengthwise (i.e., longitudinally) to form two radiation members 35 and 36 which are symmetrically disposed on both sides of the first patch line 22. Further, each of the radiation members 35, 36 comprises at least two post-shaped conductors. In the embodiment, the radiation member 35 comprises two post-shaped conductors 351, 352 and the radiation member 36 comprises two post-shaped conductors 361, 362 respectively. The second patch line 24 on the rear side 20*b* of the dielectric substrate material 20 is printed at a position corresponding to the first patch line 22 on the front side 20*a* and served as an extension conductor. At one end of the second patch line 24 corresponding to the signal feed point 21, a ground conductor 23 and two radiation members 31, 32 are formed bifurcately in a lengthwise (i.e., longitudinal) direction. The radiation members 31 and 32 are symmetrically disposed on both sides of the second patch line 24. Further, each of the radiation members 31, 32 comprises at least two post-shaped conductors. In the embodiment, the radiation member 31 comprises two post-shaped conductors 311, 312 and the radiation member 32 comprises two post-shaped conductors 321, 322 respectively. Likewise, at the other end of the second patch line 24, two radiation members 33, 34 are formed bifurcately in a lengthwise (i.e., longitudinal) direction facing the radiation members 31, 32 respectively. The radiation members 33 and 34 are symmetrically disposed on both sides of the second patch line 24. Further, each of the radiation members 33, 34 comprises at least two post-shaped conductors. In the embodiment, the radiation member 33 comprises two post-shaped conductors 331, 332 and the radiation member 34 comprises two post-shaped conductors 341, 342 respectively.

In the embodiment, each post-shaped conductor formed on the radiation member is parallel with the patch line. Also, the post-shaped conductors 331, 332 on the radiation member 33 and the post-shaped conductors 341, 342 on the radiation member 34 are extended in a direction opposite to that of the post-shaped conductors 351, 352 on the radiation member 35, the post-shaped conductors 361, 362 on the radiation member 36, the post-shaped conductors 311, 312 on the radiation member 31, and the post-shaped conductors 321, 322 on the radiation member 32. Preferably, a length of each post-shaped conductor is slightly less than one-quarter wavelength of central frequency of each operating frequency (i.e., ¼).

In the embodiment, there are six radiation members 31, 32, 33, 34, 35, and 36 on the front side 20*a* and the rear side 20*b* of the dielectric substrate material 20. Also, the radiation members 31, 33, and 35 are symmetric with respect to the radiation members 32, 34, and 36 about the first patch line 22 which is taken as a longitudinal axis. Two post-shaped conductors of each radiation member have lengths A and B both slightly less than one-quarter wavelength of central frequency of each operating frequency (i.e., ¼). As such, a balum converter of dual frequency and a radiation member of dual frequency are formed. As a result, the operating frequencies need not be harmonically related. In addition, the members 35, 36 on the front side 20*a* and the radiation members 33, 34 on the rear side 20*b* are the main body of dual frequency radiation pattern. Also, the radiation members are symmetric about the longitudinal first patch line 22. Hence, a radiation pattern of the antenna can cover 360 azimuthal degrees. Moreover, the radiation members 31, 32 on the rear side 20*b* corresponding to the signal feed point 21 are coupled to the ground conductor 23. Hence, a choke is achieved by the scheme of the invention. As a result, both the length of an external coaxial cable and an adverse effect of area variation of an external ground plane on the radiation pattern can be reduced significantly.

Additionally, the invention can adjust a parasitic effect among the post-shaped conductors by suitably changing their shapes in order to obtain a resonance of multi-frequency. As a result, the antenna of the invention not only can have an omni radiation pattern (i.e., azimuth) similar to that of the prior art sleeve antenna but also can have an antenna gain higher than that of the prior art sleeve antenna. Thus, the invention is particularly suitable to microwave applications.

Figure 3A:
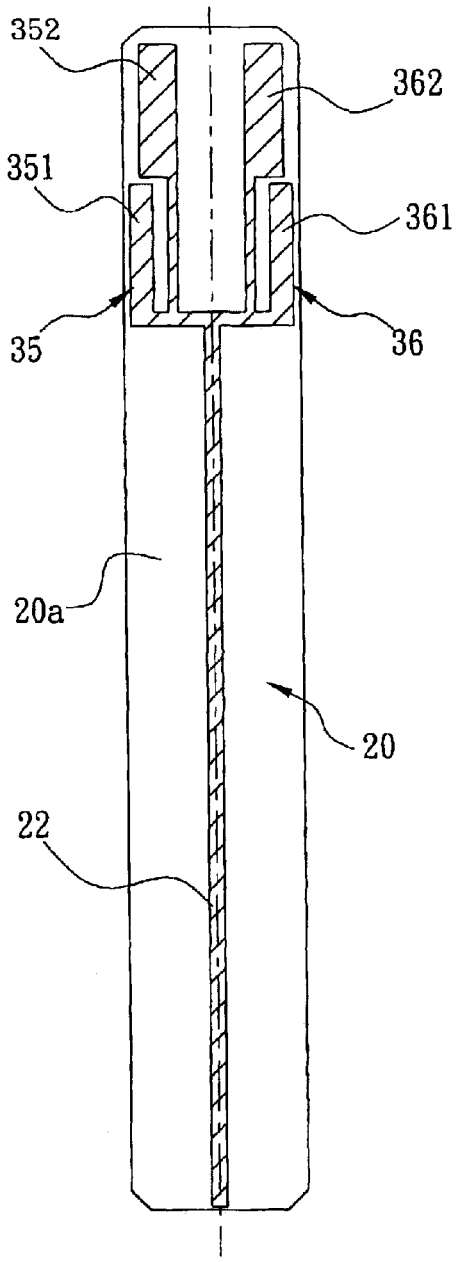
FIGS. 3*a* and 3*b* are cross-sectional views taken from the front and the rear respectively of a planar multiple band omni radiation pattern antenna according to a second preferred embodiment of the invention.
Figure 3B:
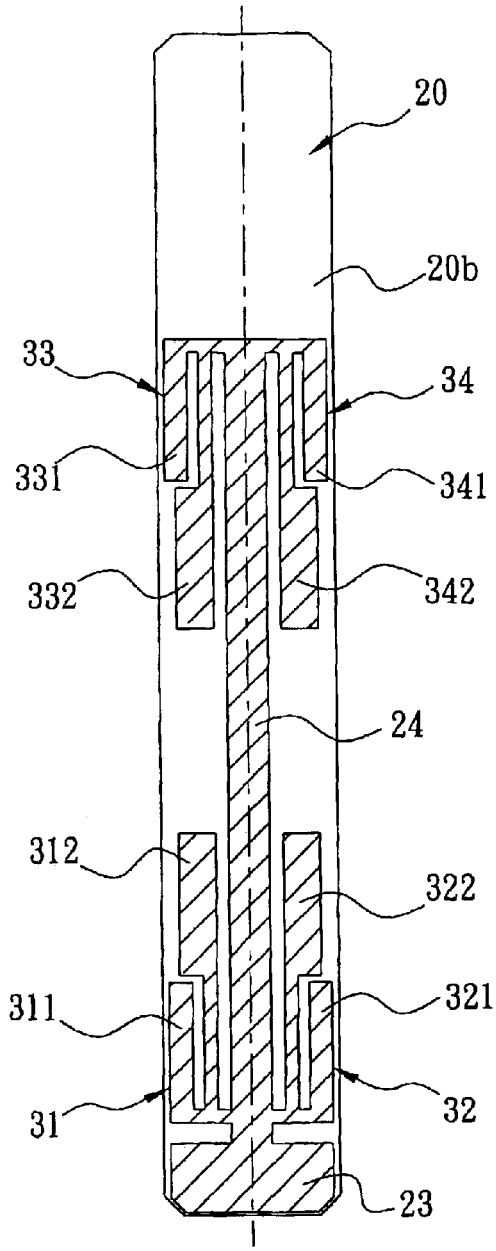
Figure 4:
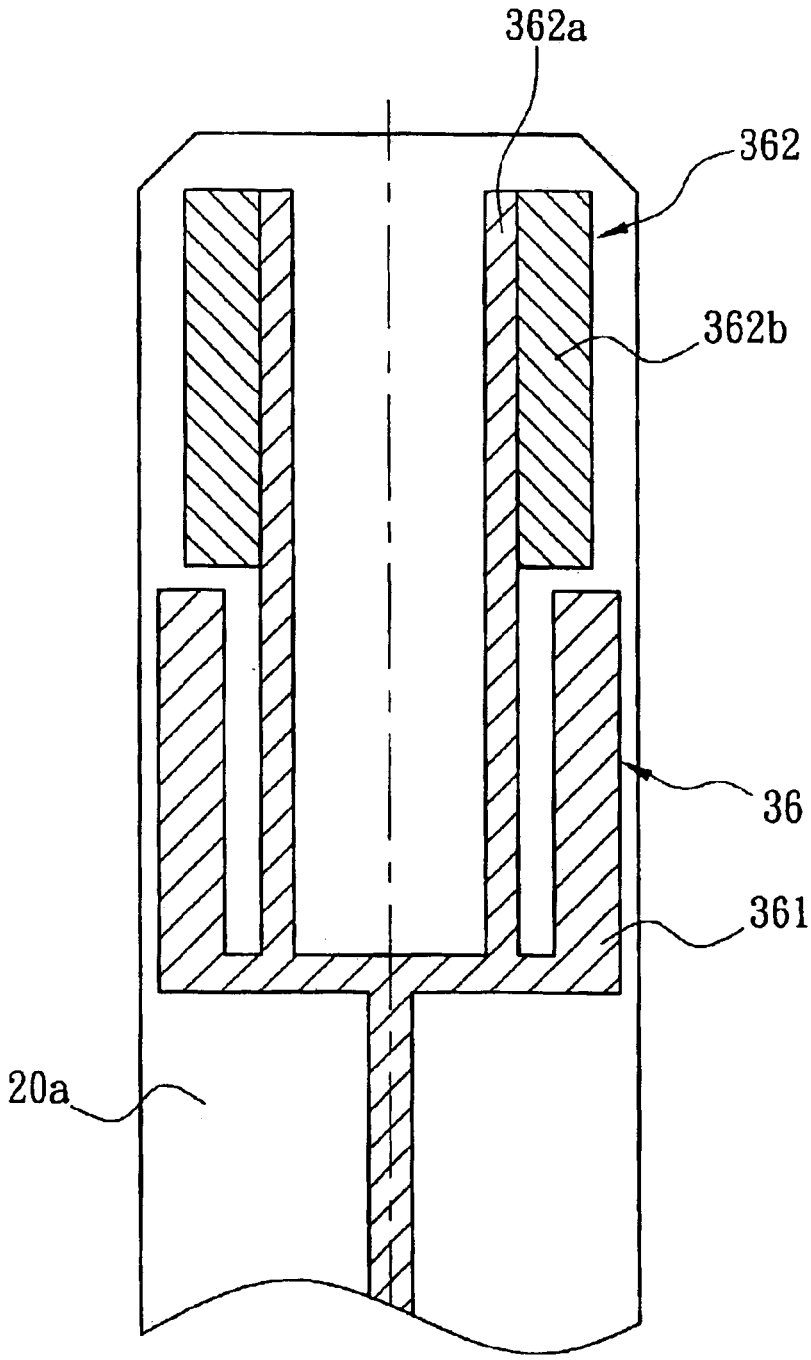
FIG. 4 is a fragmentary enlarged view of a portion of FIGS. 3*a* and 3*b;*

Referring to FIGS. 3*a* and 3*b*, there is shown an antenna in accordance with a second preferred embodiment of the invention. The second preferred embodiment substantially has same structure as the first preferred embodiment. The differences between the first and the second preferred embodiments, i.e., the characteristics of the second preferred embodiment are detailed below. The shapes of the post-shaped conductors are suitably changed in which the post-shaped conductors 312, 322, 332, 342, 352, and 362 are made longer than the adjacent post-shaped conductors 311, 321, 331, 341, 351, and 361. As shown in FIG. 4, a projection 362*a* on the post-shaped conductor 362 is extended laterally about the longitudinal axis to form a protuberance 362*a* at its side. The protuberance 362*b* is extended over an open end of the adjacent post-shaped conductor 361. At this time, a strongest electric field is generated at the post-shaped conductor 361. As such, an additional parasitic effect is occurred on the adjacent shorter post-shaped conductor 361 by the protuberance 362*b*. As a result, it is possible of effectively increasing a resonant mode and a bandwidth of the antenna, thereby effecting a multi-frequency operation purpose. Further, the shorter post-shaped conductor 361 can increase a resonance at high frequencies. As such, in the second preferred embodiment the increased frequencies are high frequencies. As an end, the second preferred embodiment is particularly suitable to microwave applications.

Figure 5A:
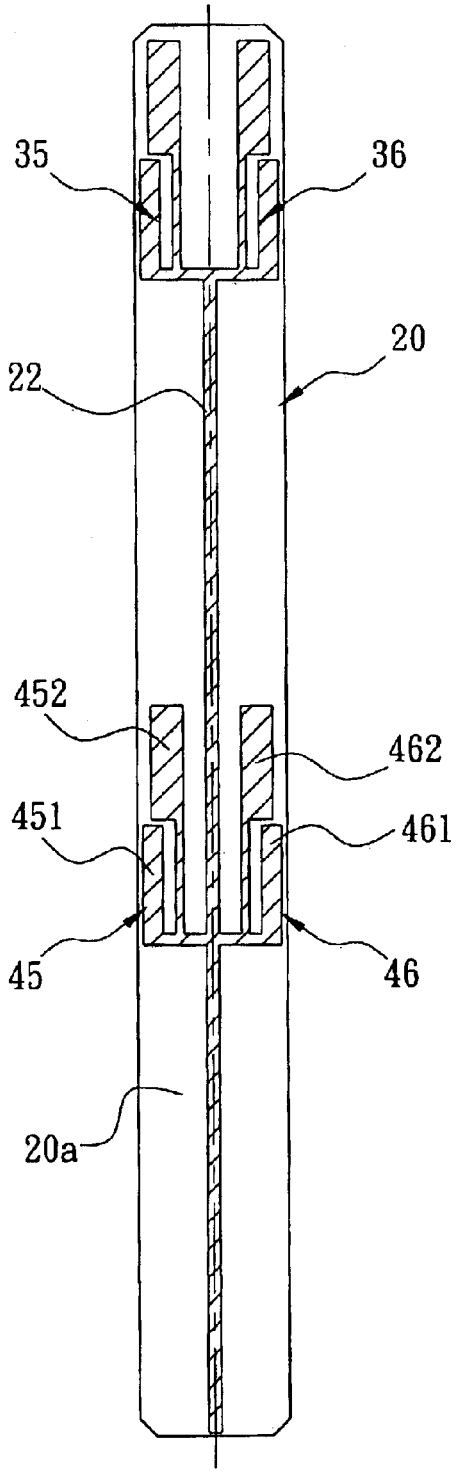
FIGS. 5*a* and 5*b* are cross-sectional views taken from the front and the rear respectively of a planar multiple band omni radiation pattern antenna according to a third preferred embodiment of the invention.
Figure 5B:
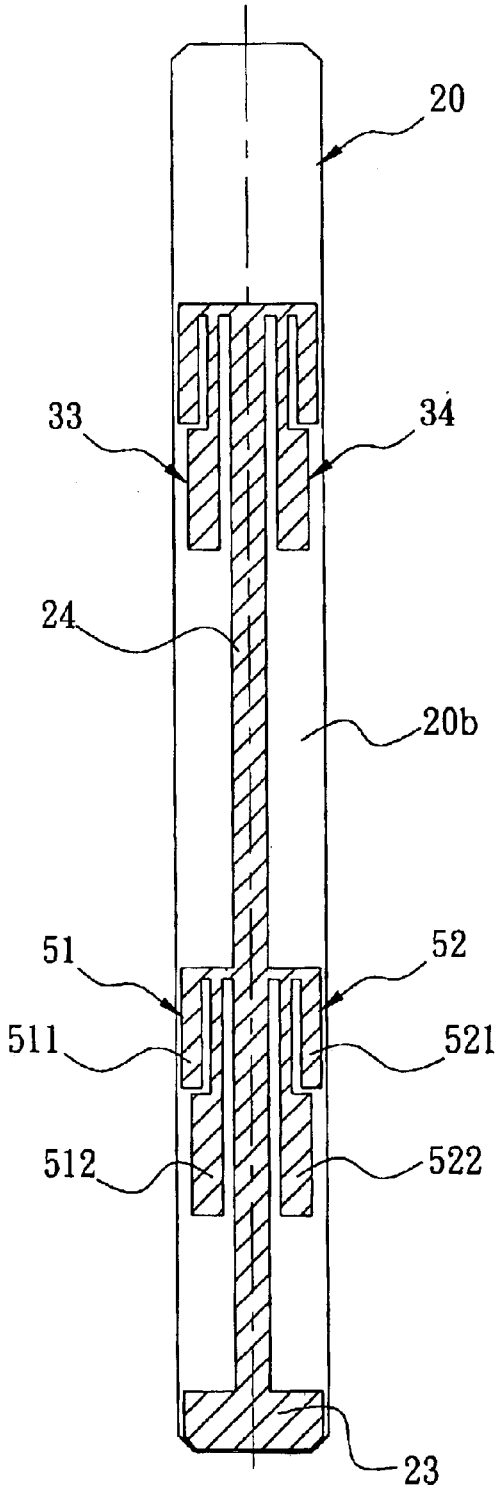

Referring to FIGS. 5*a* and 5*b*, there is shown an antenna in accordance with a third preferred embodiment of the invention. The third preferred embodiment substantially has same structure as the second preferred embodiment. The differences between the second and the third preferred embodiments, i.e., the characteristics of the third preferred embodiment are detailed below. On a suitable position of the first patch line 22 which is printed on the front side 20*a* as the signal transmission line, two radiation members 45, 46 are formed by bifurcation along a longitudinal axis. Also, the radiation members 45, 46 are symmetrically disposed on both sides of the first patch line 22. Further, the radiation member 45 comprises two post-shaped conductors 451, 452 and the radiation member 46 comprises two post-shaped conductors 461, 462 respectively. Each of the post-shaped conductors 451, 452, 461, and 462 is parallel with the first patch line 22 and extends in the same direction as the post-shaped conductors on the radiation members 35, 36. As to the second patch line 24 printed on the rear side 20*b* as the signal transmission line at a position corresponding to the radiation members 45, 46, two radiation members 51, 52 are formed by bifurcation along the longitudinal axis. Also, the radiation members 51, 52 are symmetrically disposed on both sides of the second patch line 24 and each comprises at least two post-shaped conductors. In the embodiment, the radiation member 51 comprises two post-shaped conductors 511, 512 and the radiation member 52 comprises two post-shaped conductors 521, 522 respectively Each of the post-shaped conductors 511, 512, 521, and 522 is parallel with the second patch line 24 and extends in a direction opposite to the post-shaped conductors on the radiation members 45, 46. In the preferred embodiment, each post-shaped conductor has a length slightly less than one-quarter wavelength of central frequency of each operating frequency (i.e., ¼). A collinear structure is adopted by the planar multiple band omni radiation pattern antenna of the invention because it cannot optimize all frequency bands in the multi-frequency scheme. Hence, in the above embodiments the radiation members 31, 32 printed on the rear side 20*b* are replaced by the radiation members 51, 52 for compensating the antenna gain. As a result, the multi band antenna having the collinear structure of the invention can effect an omni radiation pattern and obtain a higher antenna gain.

Figure 6A:
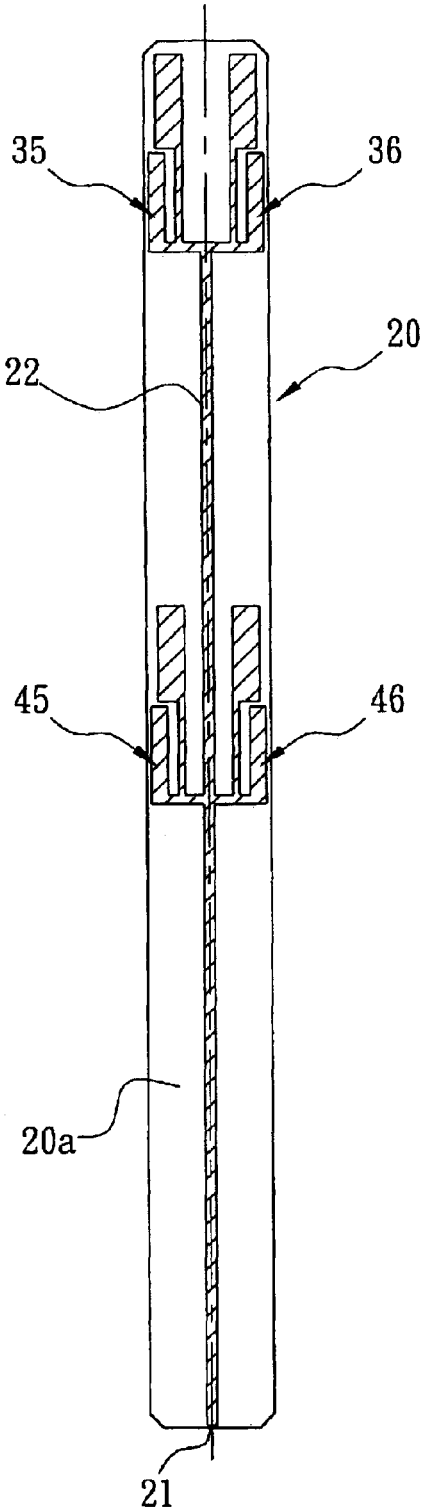
FIGS. 6*a* and 6*b* are cross-sectional views taken from the front and the rear respectively of a planar multiple band omni radiation pattern antenna according to a fourth preferred embodiment of the invention.
Figure 6B:
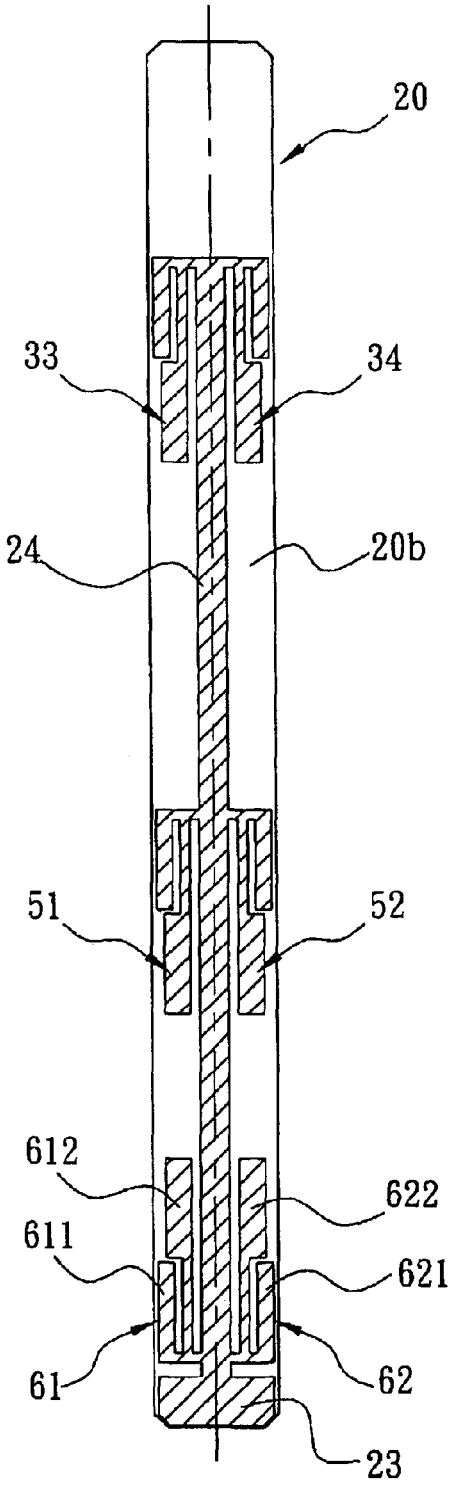

Referring to FIGS. 6*a* and 6*b*, there is shown an antenna in accordance with a fourth preferred embodiment of the invention. The fourth preferred embodiment substantially has same structure as the third preferred embodiment. The differences between the third and the fourth preferred embodiments, i.e., the characteristics of the fourth preferred embodiment are detailed below. As to the second patch line 24 printed on the rear side 20*b* as the extension conductor, at one end of the front side 20*a* corresponding to the signal feed point 21, two radiation members 61, 62 are formed bifurcately along a longitudinal direction. The radiation members 61 and 62 are symmetrically disposed on both sides of the second patch line 24. Further, each of the radiation members 61, 62 comprises at least two post-shaped conductors. In the embodiment, the radiation member 61 comprises two post-shaped conductors 611, 612 and the radiation member 62 comprises two post-shaped conductors 621, 622 respectively. Each of the post-shaped conductors 611, 612, 621, and 622 is parallel with the second patch line 24 and extends in the same direction as the post-shaped conductors on the radiation members along the first patch line 22. Hence, it is possible of providing many radiation members along two sides of the longitudinal axis of the second patch line 24 in order to manufacture a planar multiple band antenna having higher gain.

Figure 7:
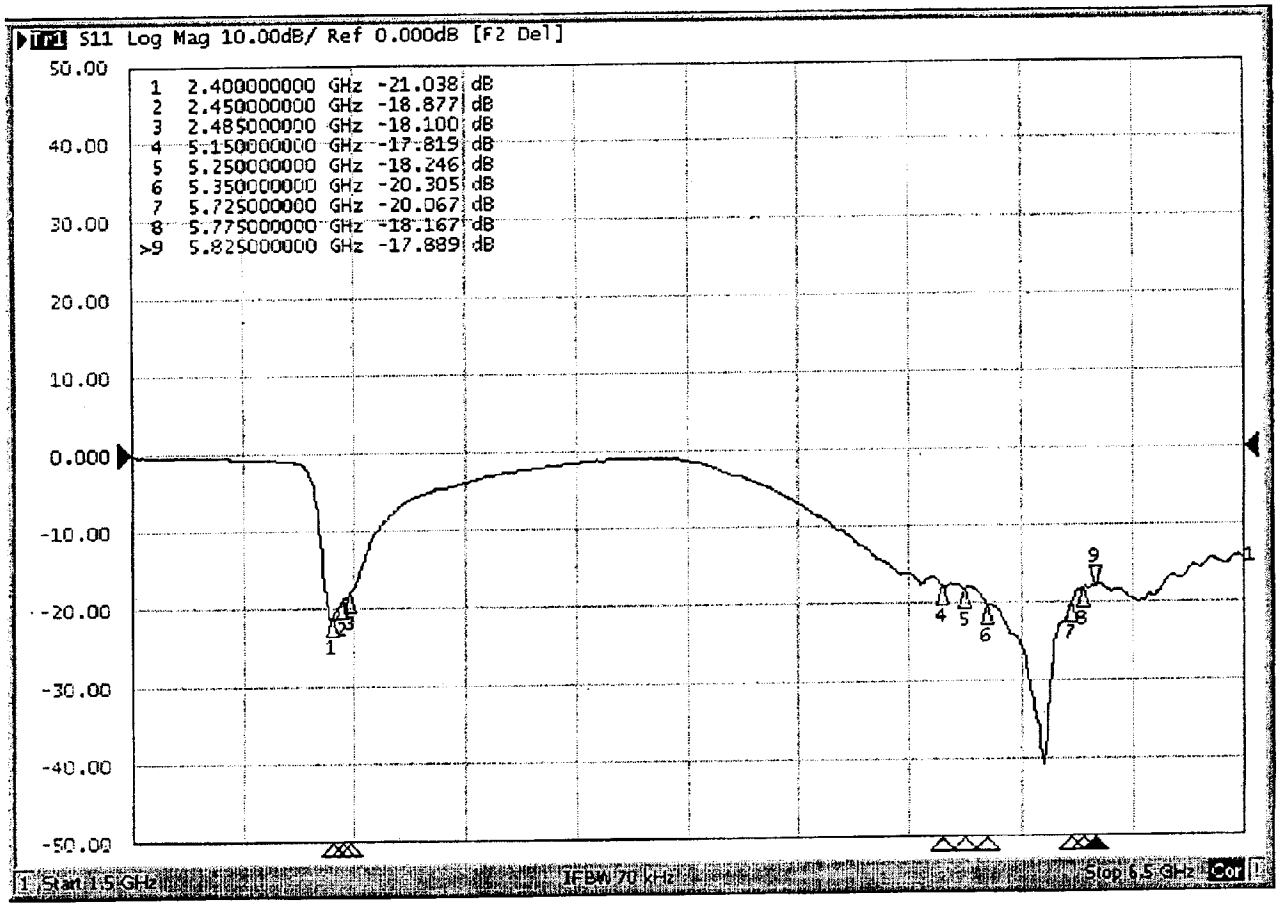
FIG. 7 is a graph showing return loss measured at the antenna of FIGS. 3*a* and 3*b;*
Figure 8A:
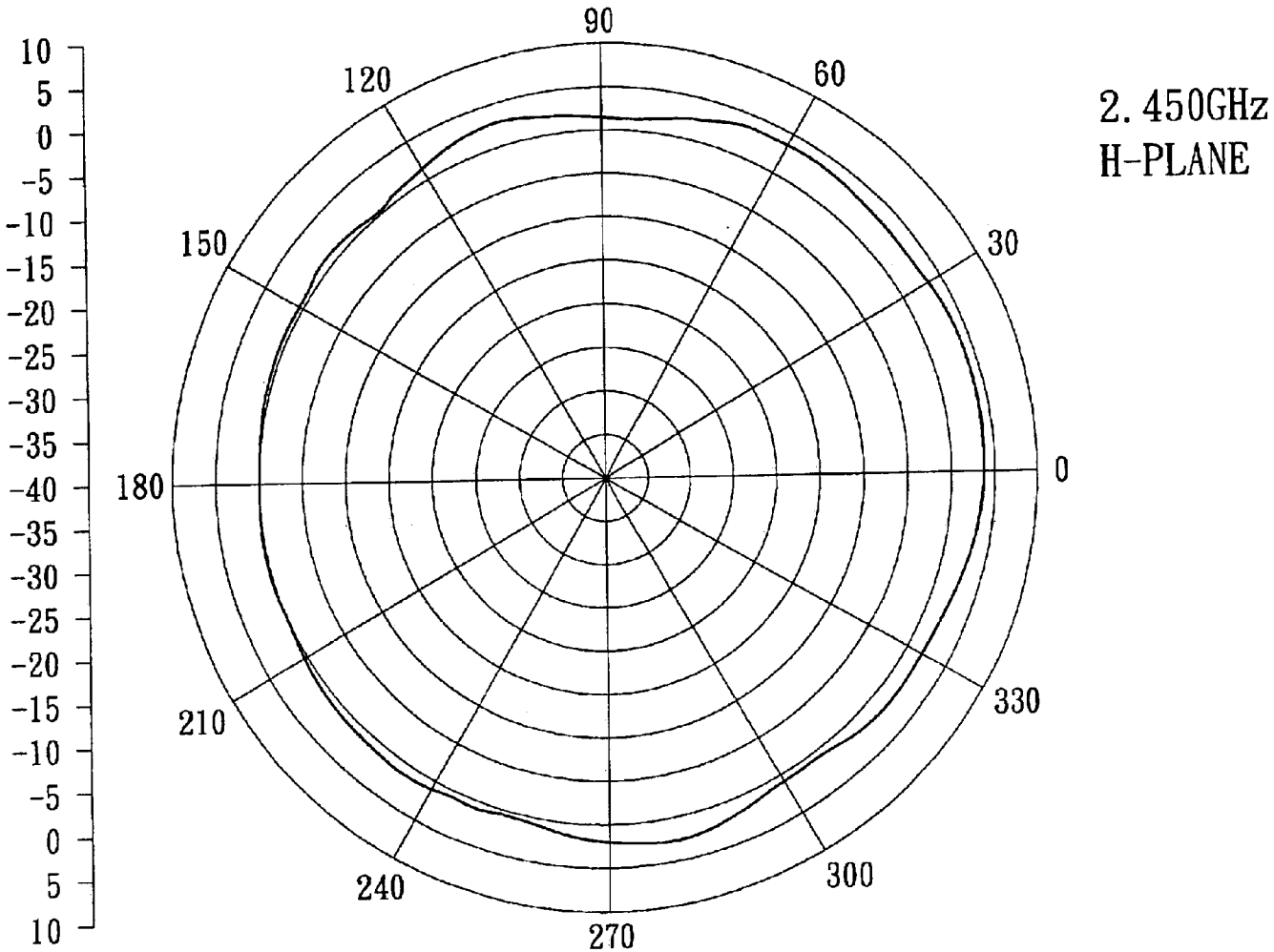
FIGS. 8*a,* 8*b,* and 8*c* are diagrams showing vertical polarization radiation patterns in H plane when the antenna of FIGS. 3*a* and 3*b* operates at 2450 MHz, 5225 MHz, and 5775 MHz respectively.
Figure 8B:
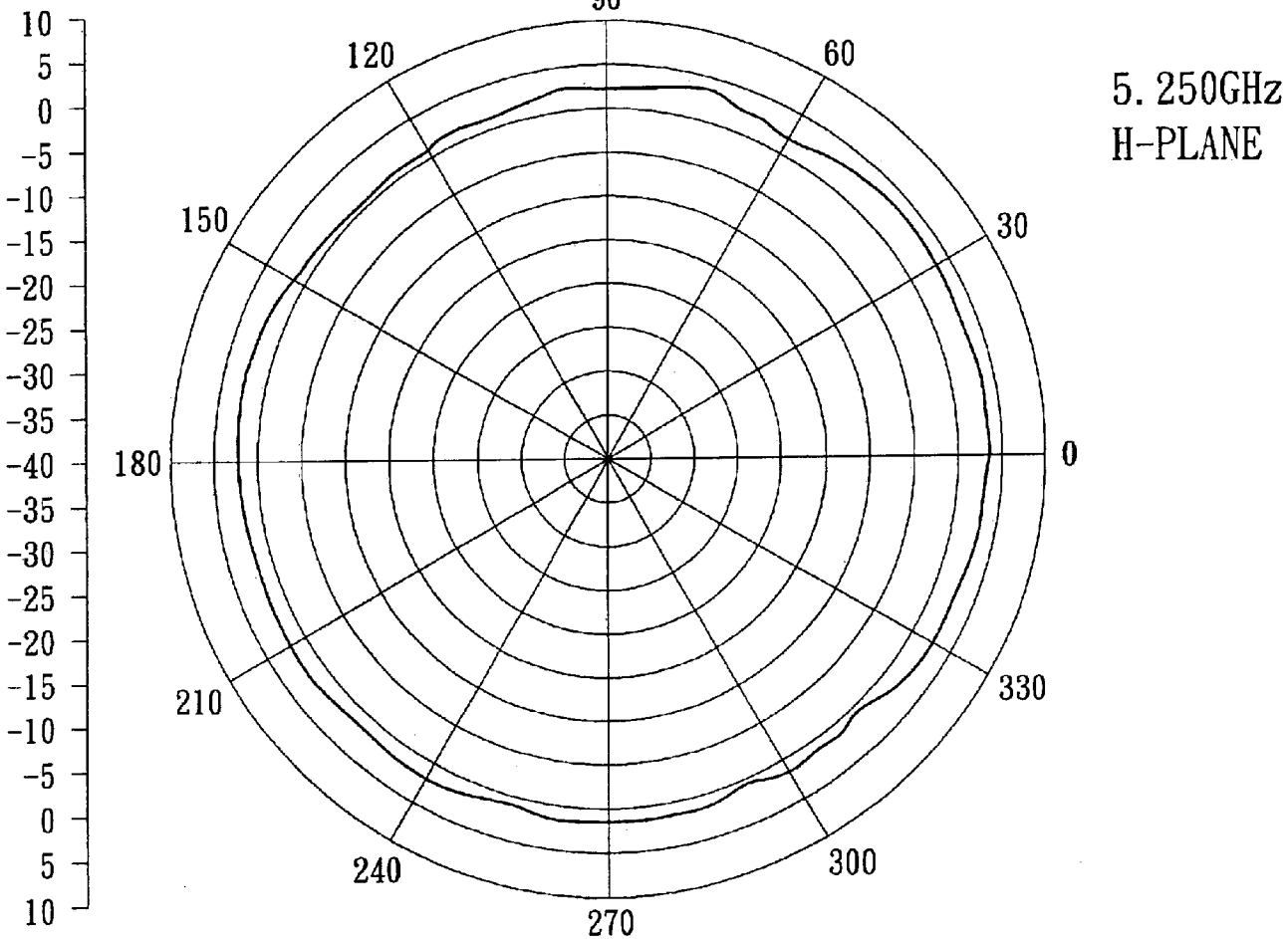
Figure 8C:
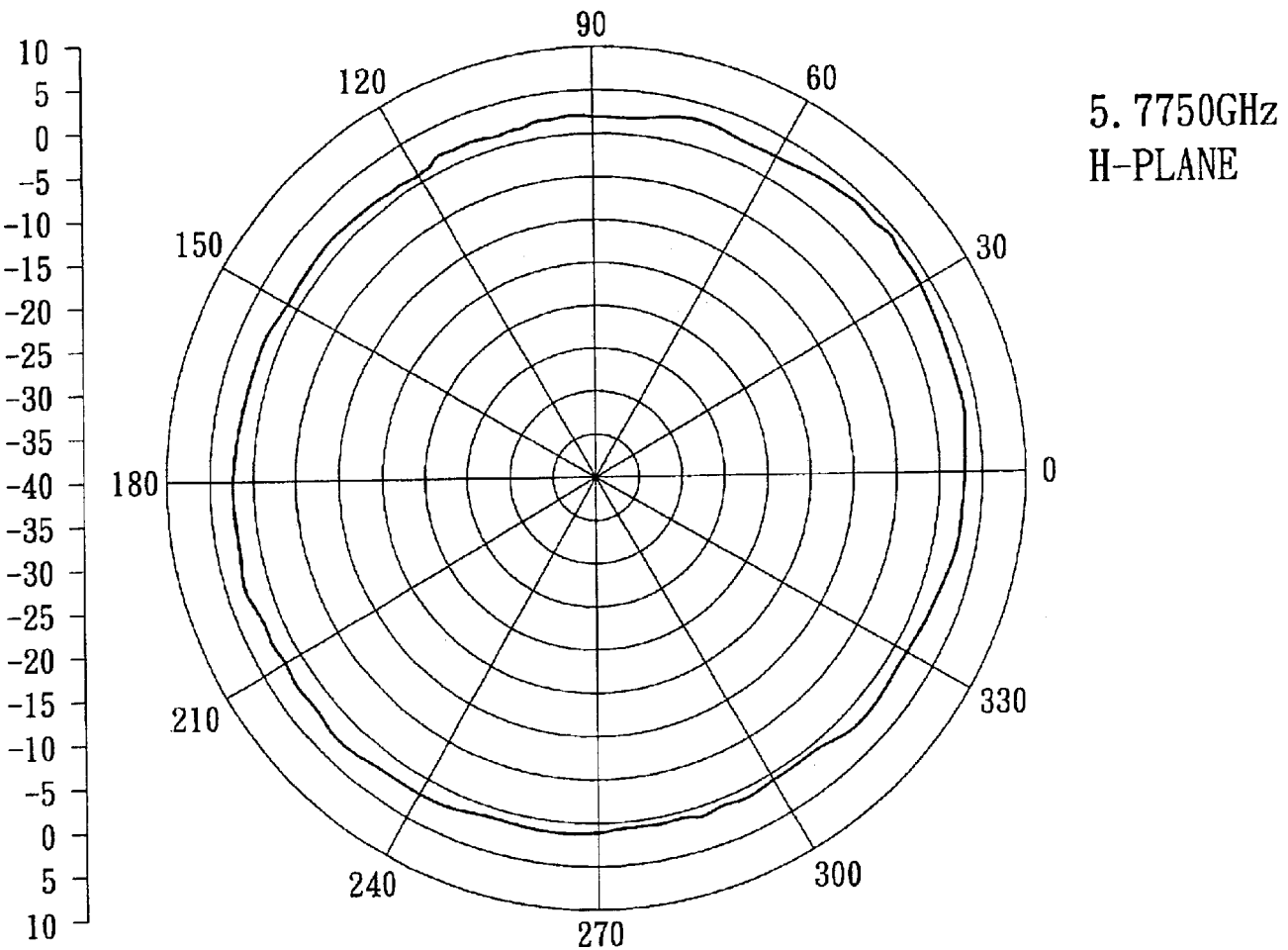
Figure 9:
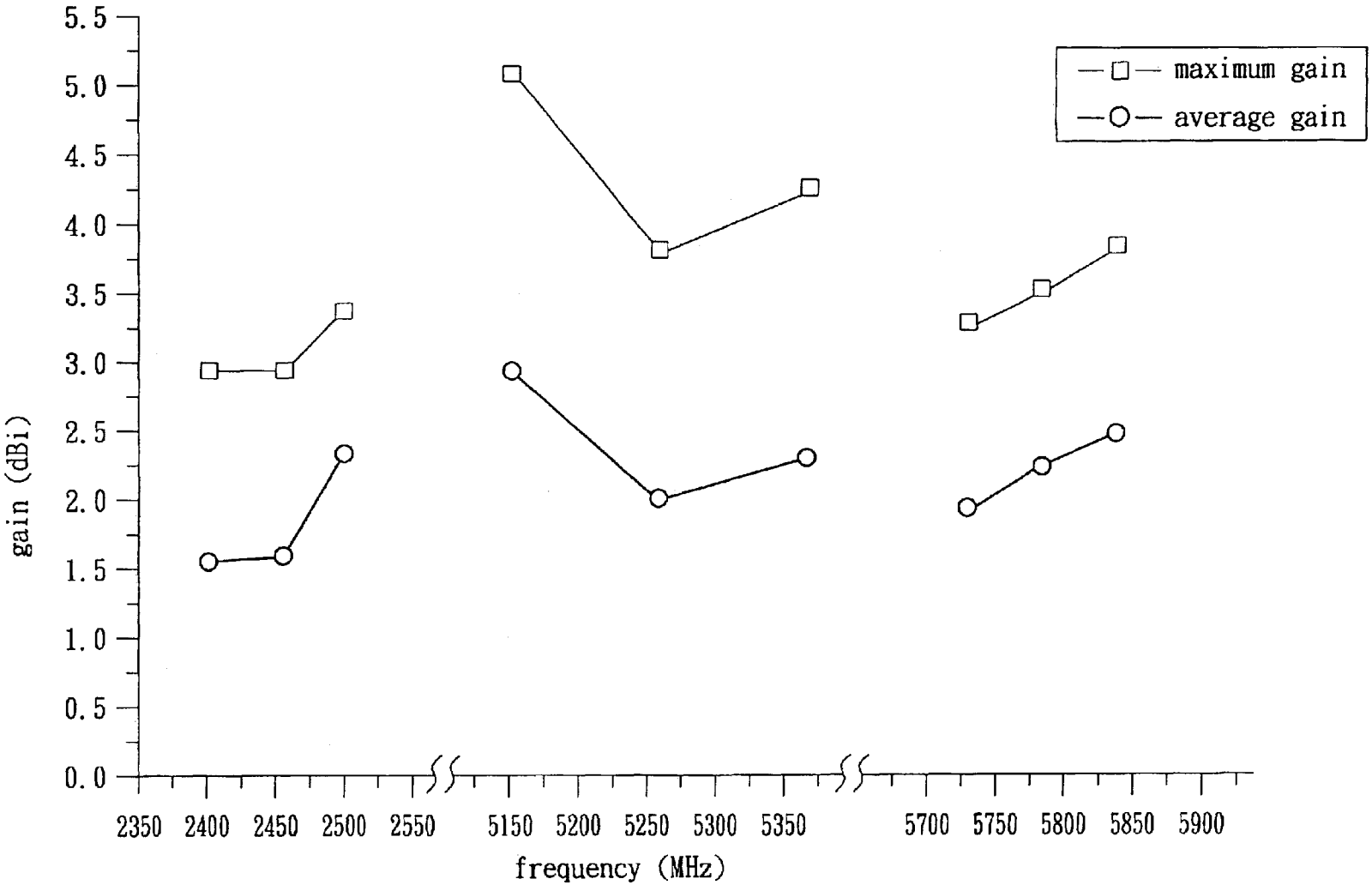
FIG. 9 is a graph showing gains measured when the antenna of FIGS. 3*a* and 3*b* operates.

In the embodiment of the invention as shown in FIGS. 3*a*, 3*b*, the patch lines and the radiation members are printed on a planar dielectric substrate material having a depth about 0.5 mm and a dielectric constant about 3 to 3.5 in order to manufacture a planar multiple band omni radiation pattern antenna of the invention. The antenna is operable at frequencies of 2.4 to 2.485 GHz, 5.15 to 5.35 GHz, and 5.725 to 5.825 GHz respectively. Further, return loss at each of the above frequencies is measured as shown in FIG. 7. It is seen that each return loss is less than 16 dB. Referring to FIGS. 8*a*, 8*b*, and 8*c*, there are shown results of vertical polarization radiation patterns in H plane when the antenna of FIGS. 3*a* and 3*b* operates at central frequencies of three operating frequencies (e.g., 2450 MHz, 5250 MHz, and 5775 MHz) respectively. As seen, good omni characteristic is obtained at each of the above frequencies. Referring to FIG. 9, it depicts three sets of maximum gains and average gains when the antenna operates at lowest frequencies, intermediate frequencies, and highest frequencies respectively. This result shows that the planar multiple band omni radiation pattern antenna of the invention can obtain a significant antenna gain in each of the operating frequencies.

While the invention has been described by means of specific embodiments, numerous modifications and variations could be made thereto by those skilled in the art without departing from the scope and spirit of the invention set forth in the claims.

What is claimed is:

1. A planar multiple band omni radiation pattern antenna comprising:

a planar dielectric substrate material;

first and second patch lines, wherein the first patch line is printed on a front side of the dielectric substrate material as a signal transmission line and the second patch line is printed on a rear side of the dielectric substrate material at a position corresponding to the first patch line for serving as an extension conductor; and a plurality of radiation members formed bifurcately, symmetrically along both sides of a longitudinal axis of each of the first and the second patch lines, each of the plurality of radiation members including at least two post-shaped conductors.

2. The antenna of claim 1, wherein one end of the first patch line is formed as a signal feed point, two first radiation members at the other end of the first patch line are formed bifurcately, symmetrically along both sides of the longitudinal axis of the first patch line, and each of the first radiation members comprises at least two post-shaped conductors.

3. The antenna of claim 2, wherein at one end of the second patch line corresponding to the signal feed point two second radiation members are formed bifurcately along the longitudinal axis of the second patch line, at the other end of the second patch line two third radiation members are formed bifurcately along the longitudinal axis of the second patch line, the second and the third radiation members are symmetrically disposed on both sides of the second patch line, and each of the second and the third radiation members comprises at least two post-shaped conductors.

4. The antenna of claim 3, wherein each post-shaped conductor on each radiation member is parallel with each patch line and the post-shaped conductors on the third radiation members at the other end of the second patch line are extended in a direction opposite to that of the post-shaped conductors on each of the first and the second radiation members.

5. The antenna of claim 2, wherein on a predetermined position of the first patch line two fourth radiation members are formed bifurcately along the longitudinal axis of the first patch line, the fourth radiation members are symmetrically disposed on both sides of the first patch line, each of the fourth radiation members comprises at least two post-shaped conductors, and each post-shaped conductor on each of the fourth radiation member is parallel with the first patch line and is extended in a direction the same as that of each post-shaped conductor on each radiation member at the other end of the first patch line.

6. The antenna of claim 5, wherein at the second patch line corresponding to the radiation members on the first patch line, two fifth radiation members are formed bifurcately along the longitudinal axis of the second patch line, the fifth radiation members are symmetrically disposed on both sides of the second patch line, each of the fifth radiation members comprises at least two post-shaped conductors, and each post-shaped conductor on each of the fifth radiation members is parallel with the second patch line and is extended in a direction opposite to that of each post-shaped conductor on each corresponding radiation member at the first patch line.

7. The antenna of claim 6, wherein at one end of the second patch line corresponding to the signal feed point two sixth radiation members are formed bifurcately along the longitudinal axis of the second patch line, the sixth radiation members are symmetrically disposed on both sides of the second patch line, each of the sixth radiation members comprises at least two post-shaped conductors, and each post-shaped conductor on each of the sixth radiation member is parallel with the second patch line and is extended in a direction the same as that of each post-shaped conductor on each radiation member at the first patch line.

8. The antenna of claim 7, wherein at one end of the second patch line corresponding to the signal feed point, a ground conductor is formed bifurcately along both sides of the longitudinal axis of the second patch line.

9. The antenna of claim 8, wherein each post-shaped conductor on each radiation member longer than the adjacent post-shaped conductor comprises a projection extended laterally about the longitudinal axis of either patch line to form a side protuberance which is extended over an open end of the adjacent post-shaped conductor.

10. The antenna of claim 8, wherein a length of each post-shaped conductor is slightly less than one-quarter wavelength of a central frequency of each operating frequency.

11. The antenna of claim 8, wherein the dielectric substrate material has a dielectric constant about 3 to 3.5.

* * * * *